US008317475B1

(12) United States Patent
Downs

(10) Patent No.: US 8,317,475 B1
(45) Date of Patent: Nov. 27, 2012

(54) TURBINE AIRFOIL WITH MICRO COOLING CHANNELS

(75) Inventor: James P Downs, Jupiter, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 504 days.

(21) Appl. No.: 12/692,744

(22) Filed: Jan. 25, 2010

(51) Int. Cl.
*F01D 5/18* (2006.01)

(52) U.S. Cl. ..... 416/97 R

(58) Field of Classification Search ..... 415/115; 416/90 R, 96 R, 97 R; 29/889.72, 889.721
See application file for complete search history.

(56) References Cited

U.S. PATENT DOCUMENTS 7,785,098 B1 * 8/2010 Appleby et al. ..... 425/470
2006/0269410 A1 * 11/2006 Downs et al. ..... 416/97 R
2008/0056908 A1 * 3/2008 Morris et al. ..... 416/97 R
2010/0119372 A1 * 5/2010 Gage et al. ..... 416/223 R
2010/0183429 A1 * 7/2010 Liang ..... 415/115
2010/0221121 A1 * 9/2010 Liang ..... 416/97 R
2011/0033311 A1 * 2/2011 Martin et al. ..... 416/97 R
2011/0143162 A1 * 6/2011 Merrill et al. ..... 428/603
2011/0171023 A1 * 7/2011 Lee et al. ..... 416/1

* cited by examiner

*Primary Examiner* — Ninh H Nguyen
*Assistant Examiner* — Liam McDowell
(74) *Attorney, Agent, or Firm* — John Ryznic

(57) ABSTRACT

An air cooled turbine airfoil having micro cooling air passages formed within the airfoil that is of such size that the present day investment coating process cannot be used. The internal cooling air features of the airfoil are formed using the Tomo Lithographic Molding (TLM) process. The TLM process is a low pressure casting process that can produce precise micro-features integral to macro-scale structures using any of the exotic alloys or other metallic materials currently being used in airfoil production. The normal internal cooling air passages as well as very small features such as trip strips, pin fins, dimples, pedestals and enclosed passages such as film holes can be produced using the TLM process.

7 Claims, 2 Drawing Sheets

TURBINE AIRFOIL WITH MICRO COOLING CHANNELS

FEDERAL RESEARCH STATEMENT

None.

CROSS-REFERENCE TO RELATED APPLICATIONS

None.

BACKGROUND OF THE INVENTION

1. Field of the Invention

The present invention relates generally to air cooled turbine airfoils, and more specifically to turbine airfoils with micro cooling channels.

2. Description of the Related Art including information disclosed under 37 CFR 1.97 and 1.98

In early engines, the power and performance of the gas turbine engines were limited by the material characteristics on operating temperature. To allow for higher turbine inlet temperatures, cooling were used in the early stage airfoils to allow for gas flow temperatures to actually exceed the material thermal limits. The first generation of air cooled turbine airfoils included radial passages extending from a supply channel formed within the blade root and through the airfoil portion to eventually discharge out the blade tip. These passages were straight and produced convection cooling only.

The next generation of air cooled airfoils included impingement cooling along with the convection cooling of the internal metal structure of the airfoil. Improved compressor compression ratios allowed for the use of higher cooling air pressures. Impingement cooling would direct a jet of pressurized cooling air onto the inner wall surface that was exposed to heat from the high temperature gas flow, which is referred to as backside cooling.

The next and latest generation of air cooled airfoils included film cooling of the external airfoil surface. Film cooling holes located at the highest external airfoil temperatures would discharge jets of air that would develop a layer of cooling air to blanket the metal surface from the hot gas flow over the airfoil. Elaborate designs for the film cooling holes have evolved into film holes that provide wider and longer lasting film layers.

Air cooled turbine airfoils are produced using the well known investment casting process in which a core having the shape of the desired internal cooling circuitry for the airfoil would be covered with a wax material to form a pattern of the airfoil. An outer ceramic coating would be applied over the wax pattern to form a mold for the inner and outer surfaces of the airfoil. The wax pattern would be leached away to leave the core and the outer airfoil surface in the mold. Molten metallic alloys material would then be poured into the mold to solidify over the core to produce the detailed internal cooling circuitry of the airfoil. The ceramic core material would then be leached away from the solidified metallic airfoil to leave the finished airfoil having the outer airfoil shape and the internal cooling circuitry. Film cooling holes would then be drilled into the airfoil walls to produce the finished airfoil. FIGS. 1 and 2 show a prior art air cooled airfoil with a multiple impingement trailing edge cooling design.

One major problem with the investment casting process used to produce a modern air cooled turbine airfoil is that the defect rate of airfoils is very high due to the ceramic cores being broken during or after the casting process to create the core, or during the casting process when the molten metallic material flows around the core details. The cores are made from a ceramic material which is very brittle. Also, the size of the features that the core will reproduce is limited to around 0.010 inches (0.25 mm). in other words, the size of small cooling air passages formed within the airfoil using a ceramic core is limited to no smaller than 0.010 inches because of the ceramic material properties. Ceramic cores are limited in size due to the granular structure of the material. Smaller sizes are not capable of being produced that can create the smaller cooling features under the 0.010 inches.

On of the major advances in gas turbine engine design of late has been the use of advanced computational fluid dynamics (CFD) modeling. With CFD modeling of the airfoil cooling circuitry, optimized designs have been discovered to improved film cooling parameters such as the blowing ratio, injection angle, and discharge coefficient and discharge trajectory. However, air cooled turbine airfoils using these CFD optimized designs cannot be produced using the current investment casting process because of the minimum core size.

BRIEF SUMMARY OF THE INVENTION

The present invention is an air cooled turbine airfoil having micro cooling air passages formed within the airfoil that are of such size that the present day investment casting process cannot be used. The internal cooling air features of the present invention are formed using the Tomo Lithographic Molding (TLM) process developed by Mikro Systems, Inc. of Charlotte, N.C. The TLM process is a low pressure casting process that can produce precise micro-features integral to macro-scale structures using any of the exotic alloys or other metallic materials currently being used in airfoil production. The normal internal cooling air passages as well as very small features such as trip strips, pin fins, dimples, pedestals and enclosed passages such as film holes can be produced using the TLM process. Also, the entire airfoil with the internal cooling air circuitry as well as the finished outer airfoil surface can be formed from the process without the requirement for a core or any of the casting processes know at the time.

Film cooling holes that open onto the airfoil surface can be formed while the airfoil is being produced using the TLM process so that drilling is not required after the airfoil has been formed. Complex film cooling hole openings can also be formed since the drilling by a laser or the formation by EDM process is not required. Film cooling holes with rounded sides and varying expansions can be produced using the TLM process while the airfoil is being produced without additional processing steps.

DETAILED DESCRIPTION OF THE INVENTION

The present invention is a turbine airfoil used in a gas turbine engine, where the turbine airfoil includes an internal cooling air circuit and film and exit cooling holes that are produced using the Tomo Lithographic Molding (TLM) process developed by Mikro Systems, Inc. of Charlotte, N.C. that can produce details much smaller than can be produced using the prior art investment casting process. The TLM process builds up the airfoil in layers without using casting or cores to produce molds that include casting. The airfoil is created with the internal passages and other features during the process that creates the entire airfoil.

Figure 1:
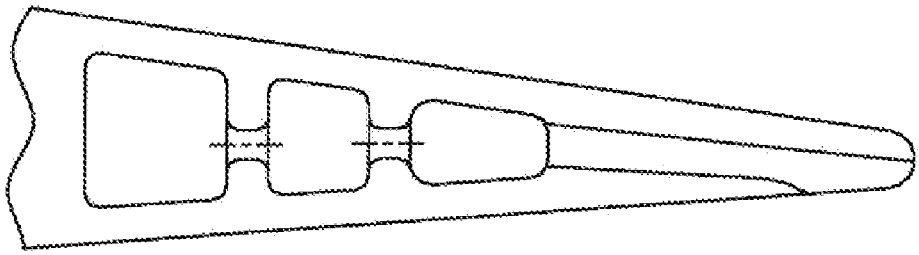
Fig 1 Prior Art
FIG. 1 shows a cross section top view of a trailing edge region cooling circuit for an airfoil of the prior art.
Figure 2:
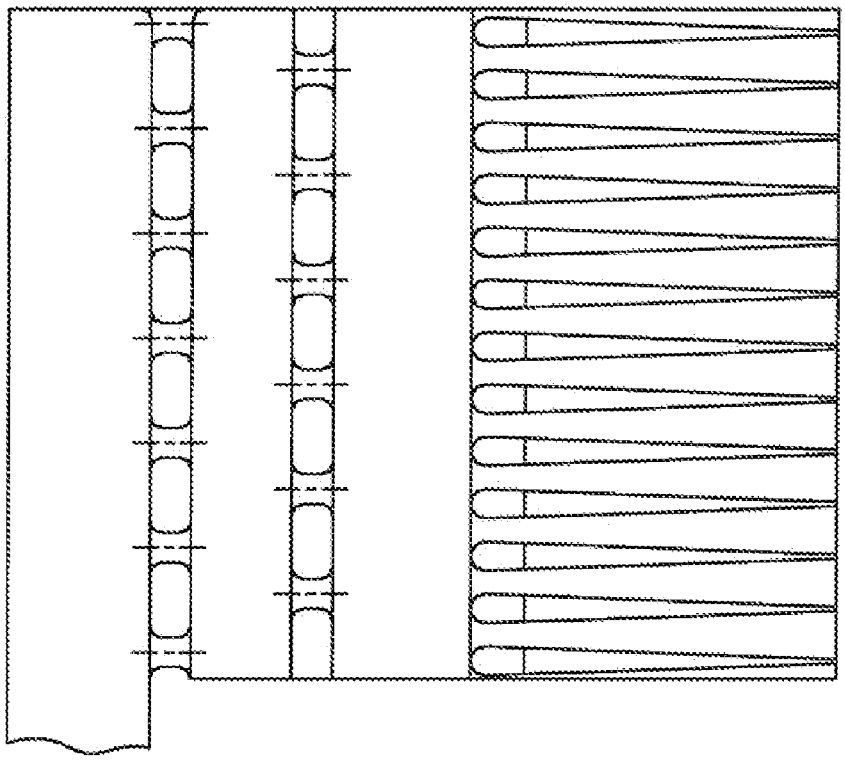
Fig 2 Prior Art
FIG. 2 shows a cross section side view of a trailing edge region cooling circuit for an airfoil of the prior art.
Figure 3:
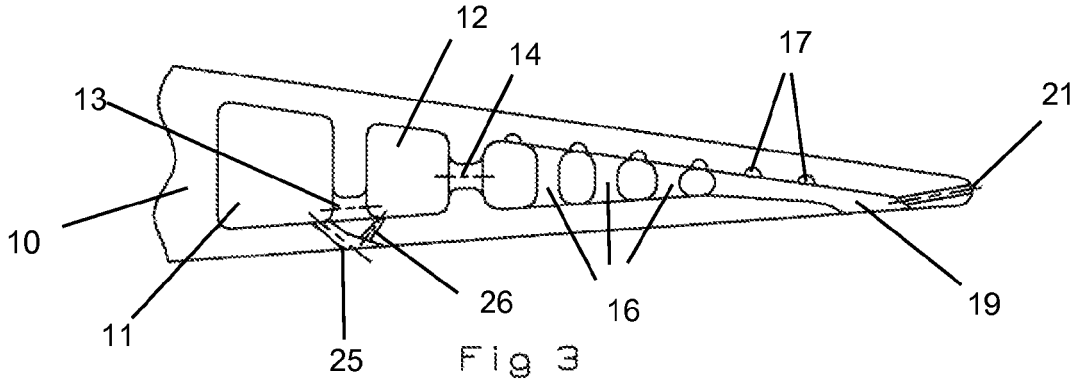
FIG. 3 shows a cross section top view of a trailing edge region cooling circuit for an airfoil of the present invention.
Figure 4:
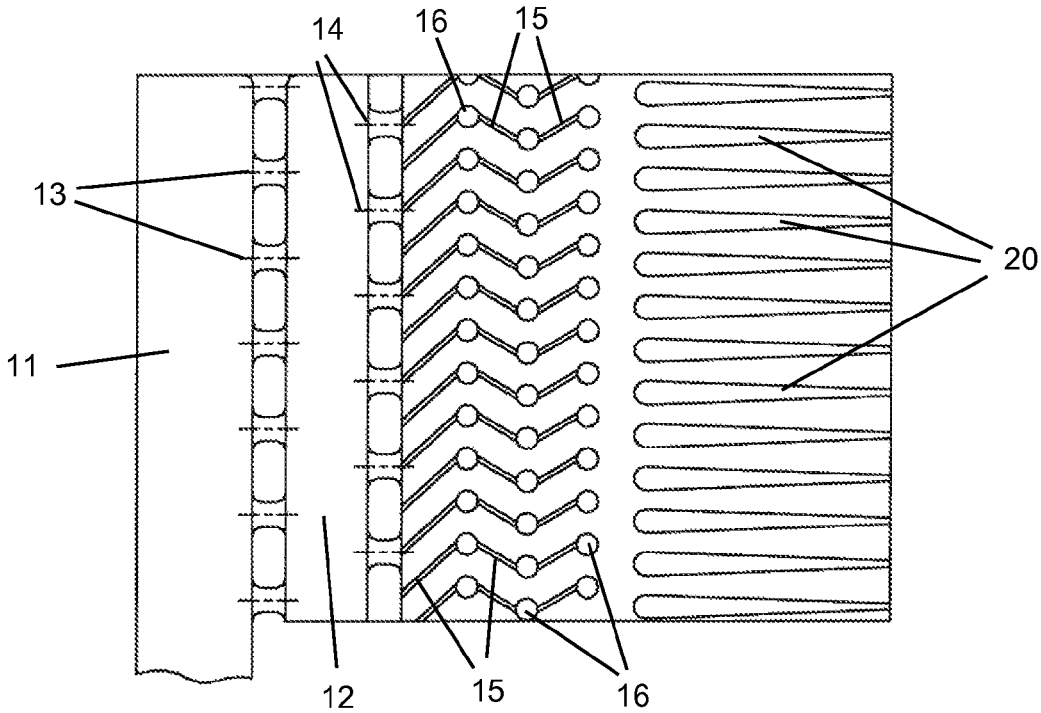
FIG. 4 shows a cross section side view of a trailing edge region cooling circuit for an airfoil of the present invention.

FIG. 3 shows a cross section of the trailing edge cooling circuit from a top view that is formed using the TLM process of the present invention. The airfoil 10 includes a first radial channel 11 and a second radial channel 12 located aft and separated by a first row of metering holes 13, where the metering holes are offset from the normal central location that is formed by the investment casting process. A second row of metering holes 14 is located aft of the second radial channel 12. Aft of the second metering holes 14 is a channel in which trip strips 15 extending between pedestals 16 are formed to enhance the heat transfer coefficient of the passages. Dimples 17 are also formed on the side surfaces of the passage. Exit slots discharge 19 on the pressure side wall of the trailing edge is formed by axial extending ribs 20 that form channels with progressively increasing height to form a diffusion channel. Smaller exit holes 21 are also formed in the trailing edge and connect the exit passages to the outer surface of the trailing edge as seen in FIG. 3.

These small features cannot be produced using the present day investment casting technique due to the limitations of the ceramic cores. With the TLM process described above, these small features such as cooling holes much less than 0.010 inches in diameter can be produced. Also, the small micro sized trip strips, pin fins, dimples and pedestals that also cannot be created using the investment casting process can be created using the TLM process. Thus, an air cooled turbine airfoil with micro sized cooling air passages or features can be produced. Also, because the internal cooling air passages and features can be formed without the need of cores or the production of cores, the acceptance rate of airfoil production is nearly 100%. Thus, manufacturing costs are drastically lowered. Also, time to manufacture is also reduced since the time consuming process of machining the ides used for the core casting is eliminated.

The TLM process can also be used to form film cooling holes in the airfoil during the process to produce the actual airfoil. Film cooling holes 25 and suck back holes 26 shown in FIG. 3 can be formed in the airfoil at any desired size, shape and angle. The suck back holes 26 with a diameter of 0.008 inches can be formed using the TLMN process. In the prior art investment casting process, the film holes would be produced along the die parting lines which would limit the angle of the film holes. In the core die used to cast the airfoil, the pulling direction is important so that draft angles are required. The TLM process used to produce the airfoil does not require these investment casting limitations in the production of the airfoil.

Other internal cooling passages, film holes and internal heat transfer augmentation features having micro scale size (that cannot be produced using the investment casting process with the cores) such as trip strips and pin fins can be formed in other parts of the airfoil using the TLM process. For example, leading edge region impingement cavities with impingement holes and metering holes can be produced. And, leading edge and gill film cooling holes can be produced with scales smaller than that capable of with the investment casting process.

I claim:

1. An air cooled turbine airfoil comprising:

a pressure side wall and a suction side wall;

a leading edge region and a trailing edge region extending between the pressure side wall and the suction side wall;

a first radial extending cooling channel located adjacent to the trailing edge region;

a trailing edge region cooling channel formed between the pressure side wall and the suction side wall;

a first row of metering holes connected between the radial extending cooling channel and the trailing edge region cooling channel;

three rows of trip strips extending across the trailing edge region cooling channel;

a row of axial ribs forming diffusion sections that open into exit slots on the pressure side wall adjacent to a trailing edge of the airfoil;

three rows of pedestals connecting the rows of trip strips and forming a zip-zap shape; and, a row of exit holes connected to the exit slots and opening onto the trailing edge of the airfoil.

2. The air cooled turbine airfoil of claim 1, and further comprising:

the trip strips and the pedestals are too small to be formed from an investment casting process.

3. The air cooled turbine airfoil of claim 1, and further comprising:

a plurality of spanwise extending dimples along the walls of the trailing edge region cooling channel and located between the rows of pedestals.

4. The air cooled turbine airfoil of claim 1, and further comprising:

a second radial extending cooling channel located forward of the first radial extending cooling channel; and, a second row of metering holes connecting the second radial extending cooling channel to the first radial extending cooling channel.

5. The air cooled turbine airfoil of claim 4, and further comprising:

the second row of metering holes is located adjacent to the pressure side wall.

6. The air cooled turbine airfoil of claim 5, and further comprising:

a shaped film cooling hole connected to the second radial extending cooling channel; and, a row of suck-back holes connecting the row of film cooling holes to the first radial extending cooling channel.

7. The air cooled turbine airfoil of claim 1, and further comprising:

the row of exit holes opening on the trailing edge are of less than 0.010 inches in diameter.

* * * * *